US006715202B2

(12) United States Patent
Beaver

(10) Patent No.: US 6,715,202 B2
(45) Date of Patent: Apr. 6, 2004

(54) TUBE BENDER FOR FORMING SERPENTINE HEAT EXCHANGERS FROM SPINE FIN TUBING

(75) Inventor: Danny D. Beaver, Tyler, TX (US)

(73) Assignee: American Standard International Inc., New York, NY (US)

( * ) Notice: Subject to any disclaimer, the term of this patent is extended or adjusted under 35 U.S.C. 154(b) by 300 days.

(21) Appl. No.: 10/005,775

(22) Filed: Nov. 2, 2001

(65) Prior Publication Data

US 2003/0084570 A1 May 8, 2003

(51) Int. Cl.[7] ..... B23P 15/26

(52) U.S. Cl. ..... 29/727; 29/726; 29/33 T; 29/819; 29/890.03; 29/890.053; 29/890.048; 72/381; 72/384

(58) Field of Search ..... 29/726, 727, 33 T, 29/282, 890.03, 890.053, 819; 72/381, 384; 493/413, 414, 415

(56) References Cited

U.S. PATENT DOCUMENTS

| | | | | |
|---|---|---|---|---|
| 1,546,147 A | * | 7/1925 | Skinner | 72/217 |
| 2,469,406 A | * | 5/1949 | Payne et al. | 72/217 |
| 2,746,727 A | * | 5/1956 | Earl | 165/168 |
| 2,876,823 A | * | 3/1959 | Knox et al. | 72/306 |
| 3,005,253 A | | 10/1961 | Venables III | |
| 3,120,383 A | * | 2/1964 | Antwerpen et al. | 493/413 |
| 3,134,166 A | | 5/1964 | Venables III | |
| 3,160,129 A | | 12/1964 | Venables III | |
| 3,673,845 A | * | 7/1972 | Vercoglio | 72/318 |
| 3,688,375 A | | 9/1972 | Venables III | |
| 4,381,592 A | | 5/1983 | Venables, III et al. | |
| 4,438,808 A | | 3/1984 | Vanables, III et al. | |
| 4,439,175 A | * | 3/1984 | Cimochowski et al. | 493/413 |
| 4,542,568 A | | 9/1985 | Venables, III et al. | |
| 4,581,800 A | | 4/1986 | Johnson | |
| 5,099,574 A | | 3/1992 | Paulman et al. | |
| 5,193,359 A | | 3/1993 | Martin et al. | |
| 5,205,138 A | | 4/1993 | Besore et al. | |
| 5,228,198 A | | 7/1993 | Paulman et al. | |
| 5,669,261 A | * | 9/1997 | Castren | 72/307 |
| 5,737,828 A | | 4/1998 | Barnes | |
| 5,896,659 A | | 4/1999 | Barnes | |

FOREIGN PATENT DOCUMENTS

| | | | |
|---|---|---|---|
| DE | 2732719 | * | 3/1978 |

* cited by examiner

*Primary Examiner*—David P. Bryant
*Assistant Examiner*—Eric Compton
(74) *Attorney, Agent, or Firm*—William J. Beres; William O'Driscoll

(57) ABSTRACT

An apparatus and method of forming serpentine heat exchanger coils from spine fin tubing involves applying spine fins to a tube while simultaneously forming the tube into a serpentine shape. The bending and fin wrapping occurs while a feed roll continues paying out the tube without interruption. Multiple bends can be made simultaneously.

10 Claims, 9 Drawing Sheets

TUBE BENDER FOR FORMING SERPENTINE HEAT EXCHANGERS FROM SPINE FIN TUBING

BACKGROUND OF THE INVENTION

1. Field of the Invention

The present invention relates to heat exchanger coils having spine fin tubing. More particularly, the present invention relates to manufacturing such a heat exchanger.

2. Description of Related Art

Some heat exchangers or coils used for transferring heat from one fluid to another comprise a tube formed into a serpentine shape. Usually a refrigerant, or some other fluid, travels through the interior of the tube, while a second fluid, such as air, passes across the tube's exterior. To enhance heat transfer between the fluids, the tube may include fins or some other heat transfer member on the exterior of the tube. Often the fins are relatively thin and delicate, thus making it difficult to form the tube into a serpentine shape without damaging the fins. The fins of spine fin tubing, as disclosed in U.S. Pat. Nos. 3,005,253; 3,134,166; 3,160,129; and 3,688,375 (all of which are specifically incorporated by reference herein), are especially fragile and easily damaged.

Currently, serpentine coils with spine fins are manufactured in multiple operations. First, the spine fins are applied to the tube by a machine known as a spine fin wrapper, as disclosed in U.S. Pat. Nos. 4,383,592 and 4,542,568. Later, the tube with the spine fins is transferred to a tube bender, which sequentially makes numerous individual bends until creating the desired serpentine shape.

Typically, each bend is made individually at one general location on the tube bender, while the tube indexes across that general location. To do this, the feeding of the tube into the tube bender must pause momentarily with every bend, which results in a slow, interrupted process.

Moreover, each bend of the tube shifts the completed portion of the coil (i.e., that which has already been formed into a serpentine shape) from one side to the other. This shifting movement can be tolerated if the coil is relatively small. With larger coils, however, attempting to shift the bulk and mass of the completed portion of the coil can damage the spine fins and inhibit the bending process.

Consequently, a need exists for a production piece of equipment that can readily produce large serpentine coils from spine fin tubing.

SUMMARY OF THE INVENTION

It is an object of the present invention to create serpentine coils without having to shift the entire coil back and forth with each bend of the coil.

Another object of the invention to provide a multi-operational machine that can apply spine fins to a tube as well as form the tube into a serpentine shape.

Another object is to apply spine fins to a tube while bending the tube at the same time.

Yet another object of the invention is to provide a tube bender that can form serpentine coils of various widths.

A further object of the invention is to form a serpentine coil without having to stop a tube feed roll with every bend of the tube.

A still further object is to provide a tube bender that can simultaneously bend a tube at multiple points.

Another object is to provide a method of creating tight, small radius bends by maintaining the tube in tension.

These and other objects of the present invention, which will better be appreciated when the following description of the preferred embodiment and attached drawing figures are considered, are accomplished in a tube bender that applies spine fins to a tube while simultaneously forming the tube into a serpentine shape.

DESCRIPTION OF THE PREFERRED EMBODIMENT

Figure 1:
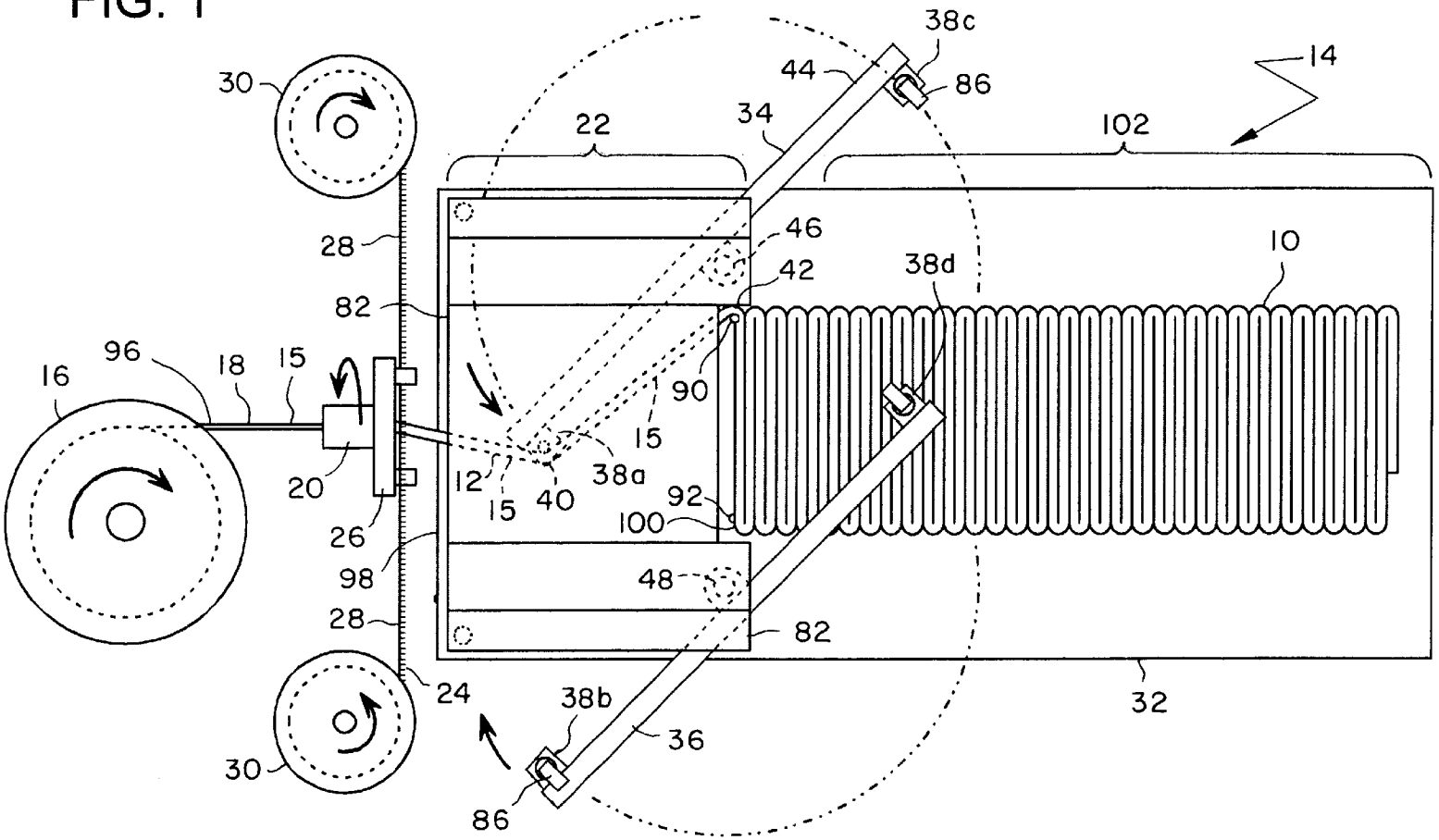
FIG. 1 shows a top view of a tube bender simultaneously wrapping spine fins around a tube and bending the tube according to one embodiment of the invention.

To create a serpentine coil 10 made of spine fin tubing 12, a tube bender 14 includes a feed roll 16 that delivers a tube 18 through a spine fin wrapper 20 and a bending station 22, as shown in FIG. 1.

Spine fin wrapper 20 applies a heat conductive member, such as spine fins 24, to the outer diameter of tube 18 to create spine fin tubing 12. In some cases, tubing 12 starts out as ⅜" diameter aluminum tubing with aluminum spine fins increasing its overall final diameter to 1.5"; however, various other diameters and materials are well within the scope of the invention. Spine fins 24 are preferably applied to tube 18 by having a rotating head 26 helically wrap one or more ribbons 28 of spine fins 28 around tube 18, as feed roller 16 pays out tube 18 through a central aperture of head 26. A roller 30 can feed the ribbon of spine fins 24 to head 26. Further details of spine fin wrapper 20 can be found in U.S. Pat. Nos. 4,381,592 and 4,542,568, which are specifically incorporated by reference herein.

While spine fins 24 are applied to tubing 18, station 22 bends tube 12 into the serpentine shape. To do this, station 22 includes a frame 32 with two rotating members 34 and 36. As viewed in FIG. 1, member 34 rotates counterclockwise, while member 36 rotates clockwise. Upon the completion of each bend, the position of members 34 and 36 are about 90-degrees out of phase with each other. This allows dies 38*a*, 38*b*, 38*c* and 38*d*, which are mounted to members 34 and 36, to sequentially engage tube 12 over bending region 22 of frame 32, and thus bend tube 12 as members 34 and 36 rotate. For example, die 38*a* simultaneously bends tube 12 at points 40 and 42 as member 34 rotates from its position of FIG. 1 to that of FIG. 2.

Figure 3:
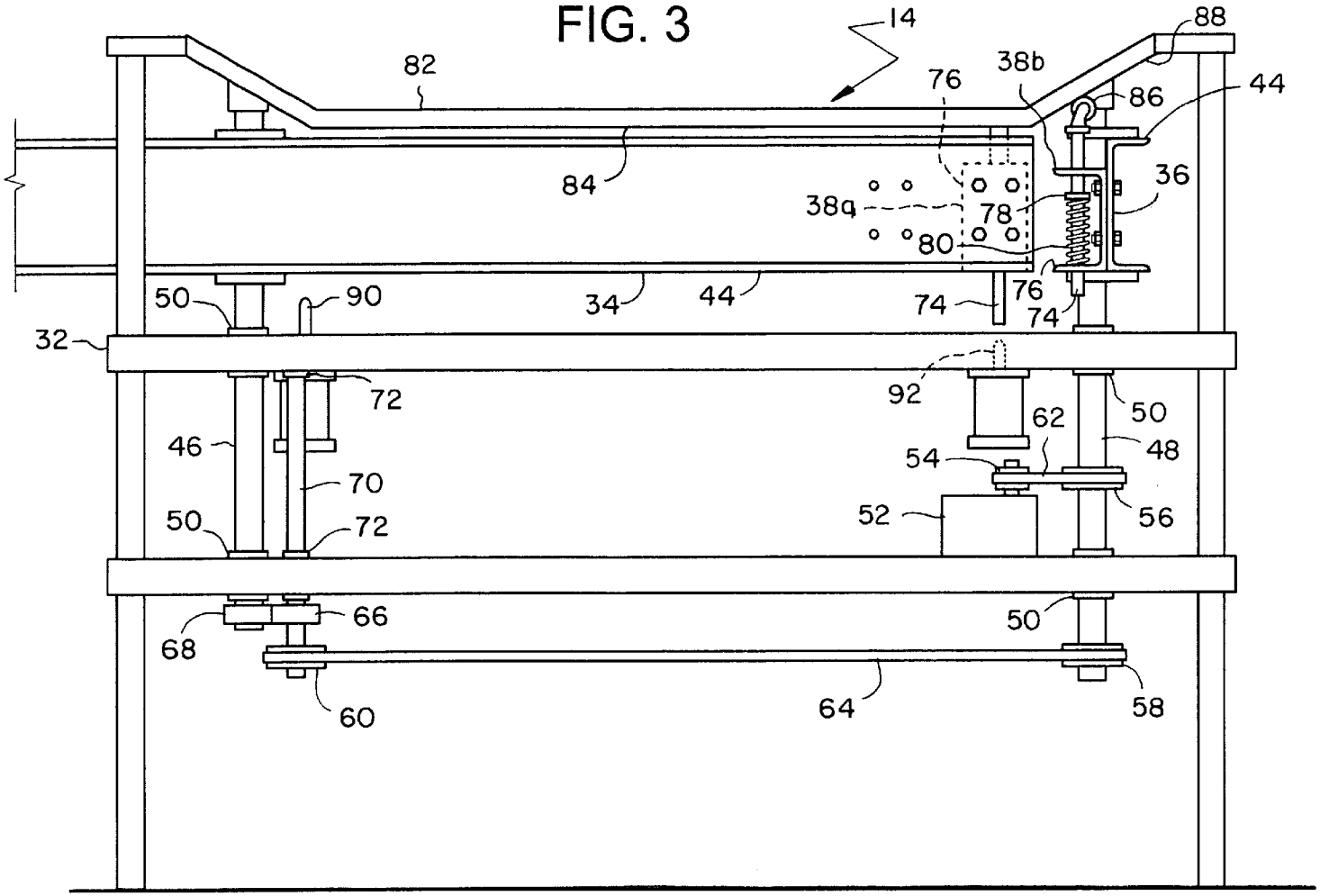
FIG. 3 is a view taken along line 3—3 of FIG. 2, but with the tube omitted to show other features of the invention more clearly.

The actual structure of bending station 22 can vary widely. However, in one form of the invention, members 34 and 36 each comprise a structural channel 44 welded or otherwise fixed to a shaft 46 or 48. Referring further to FIG. 3, bearings 50 allow members 34 and 36, and their respective shafts 46 and 48, to rotate relative to frame 32. A drive motor 52 rotates shafts 46 and 48 by way of a drive train comprising sheaves or sprockets 54, 56, 58 and 60; belts or chains 62 and 64; and gears 66 and 68. Sprockets 56 and 58 are fixed to shaft 48, gear 68 is fixed to shaft 46, and gear 66 and sprocket 60 are fixed to a shaft 70. Bearings 72 allow shaft 70, gear 66 and sprocket 60 to rotate relative to frame 32. Gears 66 and 68 mesh to rotate members 34 and 36 in opposite directions.

Figure 4:
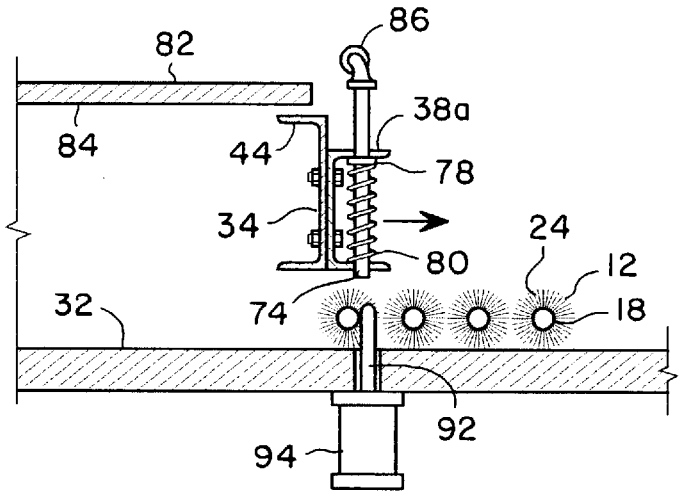
FIG. 4 is a cross-sectional view taken along line 4—4 of FIG. 7.
Figure 5:
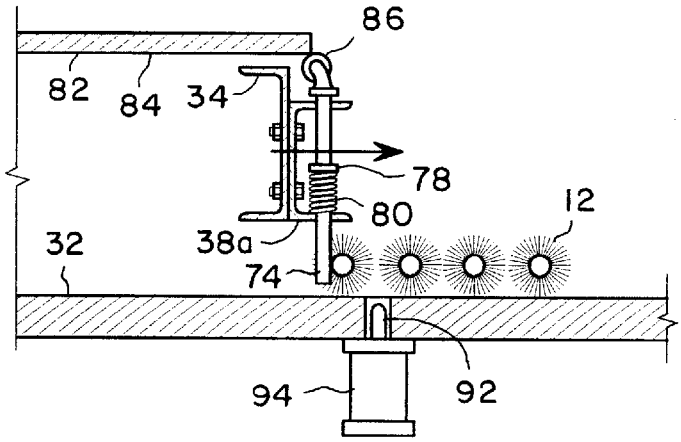
FIG. 5 is a cross-sectional view taken along line 5—5 of FIG. 2.

Dies 38*a–d* each has a retractable protrusion 74 that slides vertically within a C-shaped bracket 76, which in turn is bolted to channel 44, as shown in FIGS. 3 and 4. A shoulder 78 fixed relative to protrusion 74 allows a compression spring 80 acting between shoulder 78 and a lower flange of bracket 76 to urge protrusion 74 to a retracted position, as shown in FIG. 4. However, when die 38*a* is underneath an upper plate 82, a cam surface 84 of plate 82 applies a downward force against a roller 86, which moves protrusion 74 to an operative position of FIG. 5. In the operative position, protrusion 74 is able to engage and thus bend tube 12 as member 34 moves protrusion 74 across bending region 22. Once a particular bend has been completed, member 34 moves die 38*a* out from underneath surface 84. This allows spring 80 to push protrusion 74 back up to its retracted position where protrusion 74 disengages tube 12, as shown in FIG. 4. Referring to FIG. 3, an inclined portion 88 of cam surface 84 provides roller 86 with a gradual lead-in for moving protrusion 74 from its retracted position to its operative position.

Figure 6:
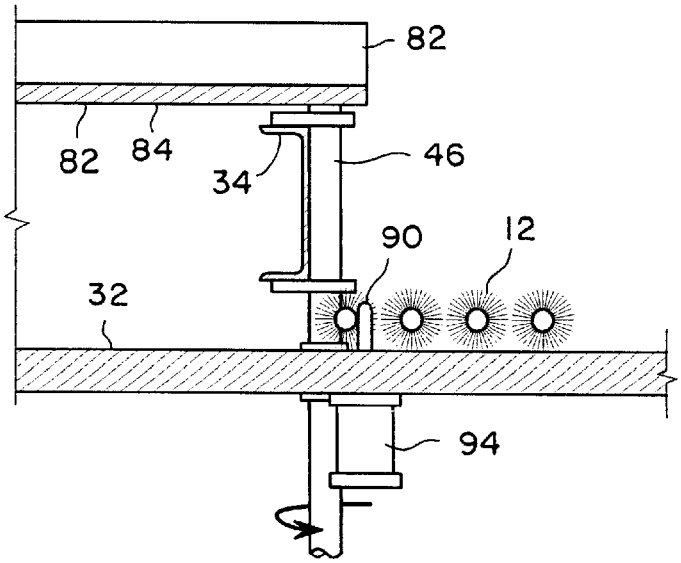
FIG. 6 is a cross-sectional view taken along line 6—6 of FIG. 2.

To temporarily hold point 42 generally fixed while member 34 bends tube 12 at points 40 and 42, a retractable anchor 90 is mounted to frame 32 in the general vicinity of point 42. For member 36, a similar anchor 92 is disposed at another point 100 complementary to point 42. In some forms of the invention, anchors 90 and 92 each comprise an air cylinder 94 that extends and retracts between a release position of FIG. 5 and an extended position of FIGS. 4 and 6.

In operation, feed roll 16 unwraps tube 18 to create an unwrapped section of tube 15 extending from a point 96 to point 42, with point 40 being at an intermediate position between points 42 and 96. Fin wrapper 20 wraps spine fins 24 around tube 15 at a location between points 96 and 40. Upon leaving fin wrapper 20, tube 15 passes across a tube-receiving end 98 of frame 32 and extends over bending region 22. With tube 15 and bender 14 in the position of FIG. 1, anchor 90 extends (see FIG. 6) to help hold tube 12 at point 42, while member 34 pushes protrusion 74 of die 38*a* against tube 12 at point 40. Tube bender 14 moving from the position of FIG. 1 to that of FIG. 2 completes the bend at point 42 and, at the same time, partially bends tube 12 at point 40.

The relative rotational speed of member 34 and feed roll 16 helps maintain tube 15 in tension, which helps keep tube 12 generally straight between points 40 and 42. In some embodiments of the invention, feed roll 16 has a certain amount of rotational drag that creates tension in tube 15 as members 34 and 36 pull tube 15 from feed roll 16. In other embodiments, feed roll 16 is driven at a generally constant speed, while drive 52 (FIG. 3) is a hydraulic motor supplied with hydraulic fluid at a constant pressure. This results in a constant rotational torque being applied to members 34 and 36, thereby limiting the tension in tube 15.

Figure 2:
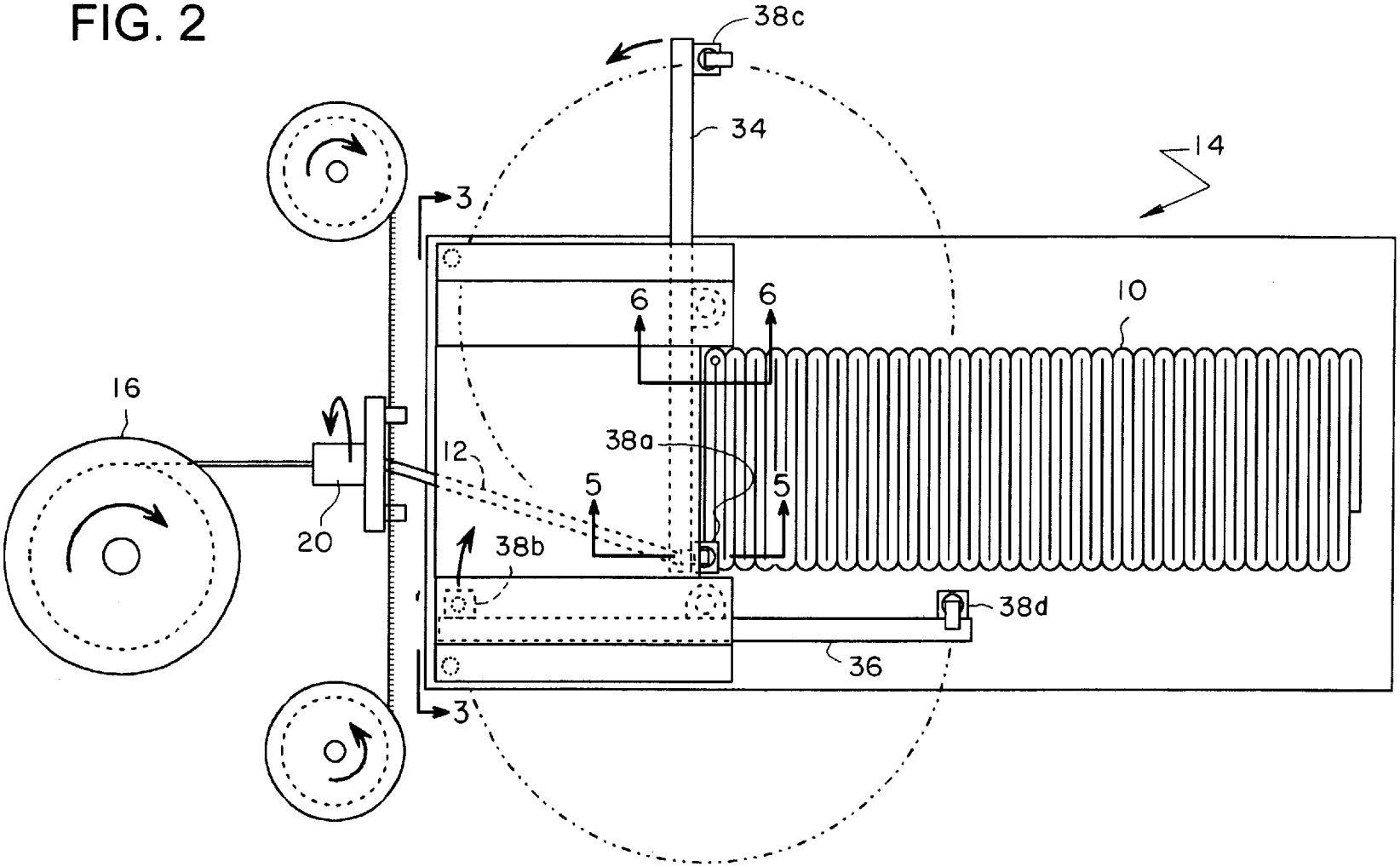
FIG. 2 shows a top view of the tube bender of FIG. 1, but shown in another position.
Figure 7:
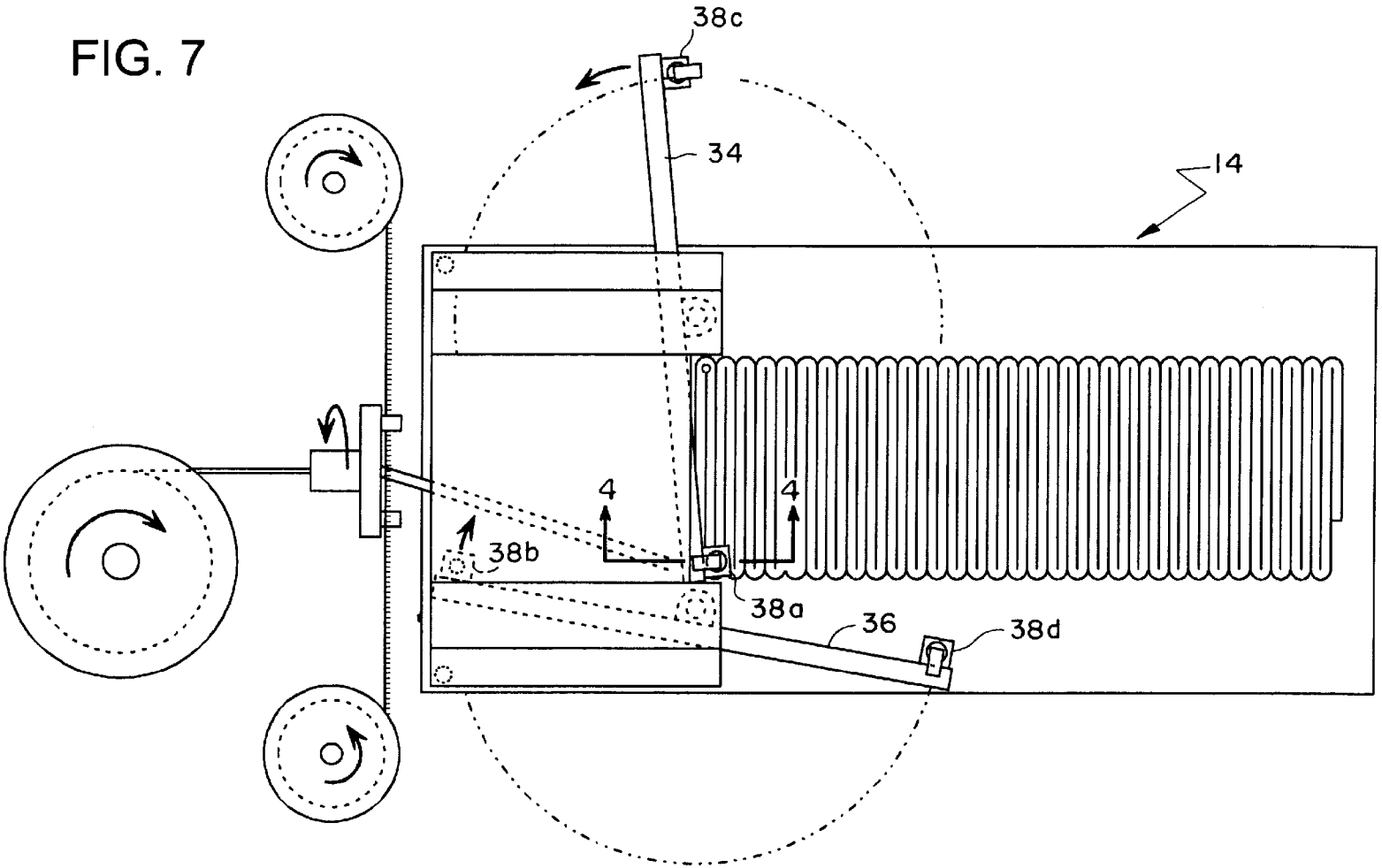
FIG. 7 shows a top view of the tube bender of FIG. 1, but shown in another position.

As members 34 and 36 continue rotating from the position of FIG. 2 to that of FIG. 7, member 34 moves die 38*a* out from underneath cam surface 84. This allows spring 80 to push protrusion 74 back up to its retracted position where protrusion 74 disengages tube 12, as shown in FIG. 4. Also, in preparation for completing the bend at point 100 as well as initiating the next bend, member 36 moves die 38*b* along inclined portion 88 of cam surface 84 (see FIG. 3) to extend protrusion 74 to its operative position. In addition, anchor 92 retracts to its release position of FIG. 5, and anchor 90 extends to its extended position of FIG. 6. Conventional fluid control valves can actuate anchors 90 and 92 at the precise time in response to conventional limit switches that sense the position of member 34 or 36.

Figure 8:
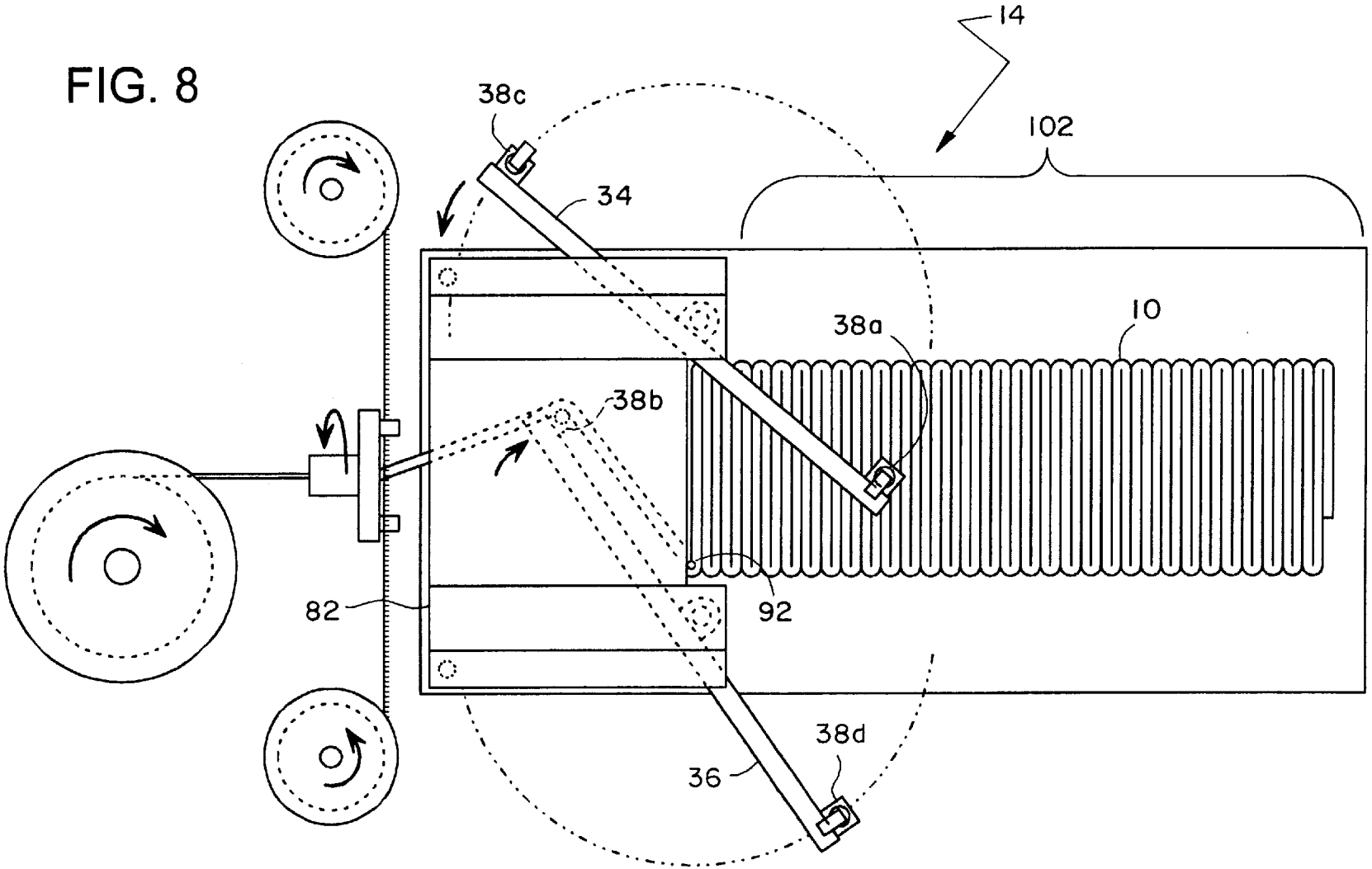
FIG. 8 shows a top view of the tube bender of FIG. 1, but shown in another position.

Next, members 34 and 36 move from their positions of FIG. 7 to that of FIG. 8. FIG. 8 is similar to FIG. 1; however, member 34 and die 38*a* do the bending in FIG. 1, while in FIG. 8, member 36 and die 38*b* do the bending. Thus, in FIG. 8, die 38*b* is in its operative position, anchor 92 is in its extended position, and anchor 90 is in its release position. Also, die 38*a* being out from underneath upper plate 82 is in its retracted position. This allows die 38*a* to pass over the completed serpentine portion 10 of tube 12 that is resting upon a support structure 102 of frame 32.

Figure 9:
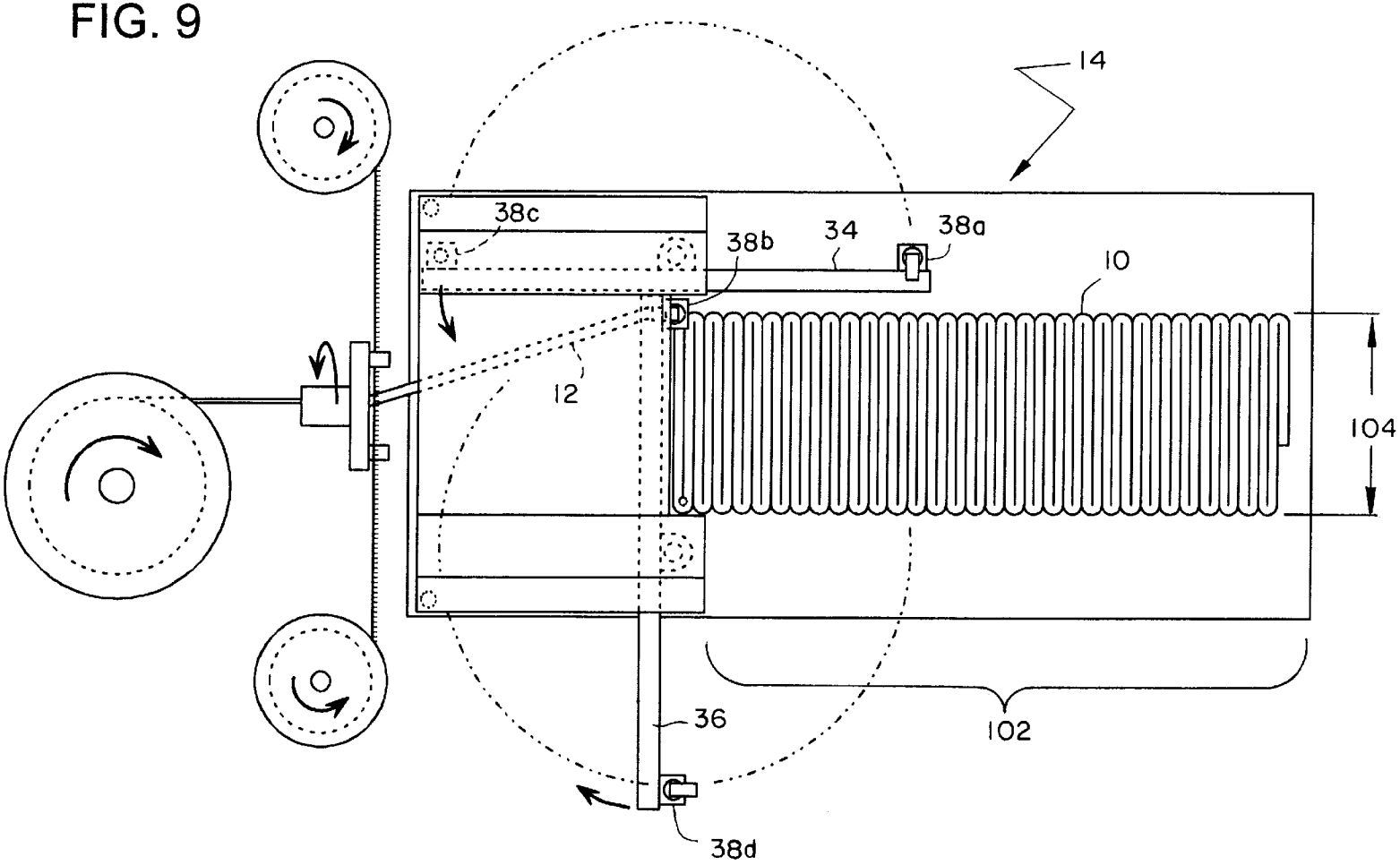
FIG. 9 shows a top view of the tube bender of FIG. 1, but shown in yet another position.

From the positions of FIG. 8, members 34 and 36 rotate to the positions shown in FIG. 9. FIG. 9 is similar to FIG. 2; however, die 38*b* of member 36, rather than die 38*a* of member 34, has just completed a bend. As members 34 and 36 continue rotating, die 38*c* is next to bend tube 12, followed by die 38*d*, and then die 38*a* comes around again to make yet another bend, which begins another cycle. As the repeating cycles continue, the serpentine portion 10 of the coil grows to the right, as viewed in FIG. 9, until the coil is cut to a desired length and removed from support structure 102. From there, the serpentine coil can be made into a complete heat exchanger, which may include framework, manifolds, inlet and outlet ports, etc. The coil may also be formed further into a shape other than just flat.

Figure 10:
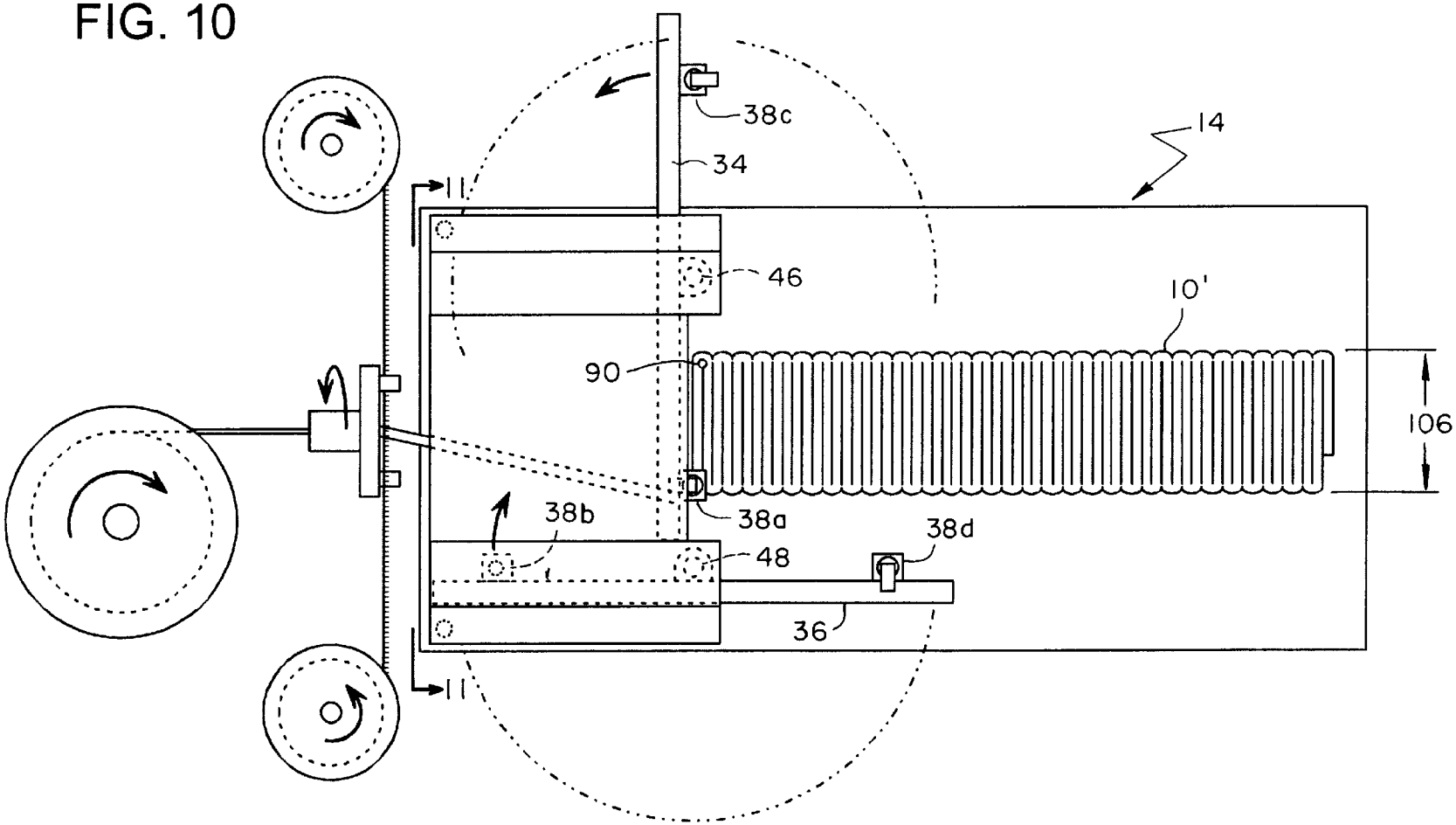
FIG. 10 shows a top view of the tube bender of FIG. 1, but with the tube bender adjusted to form a narrower serpentine coil.
Figure 11:
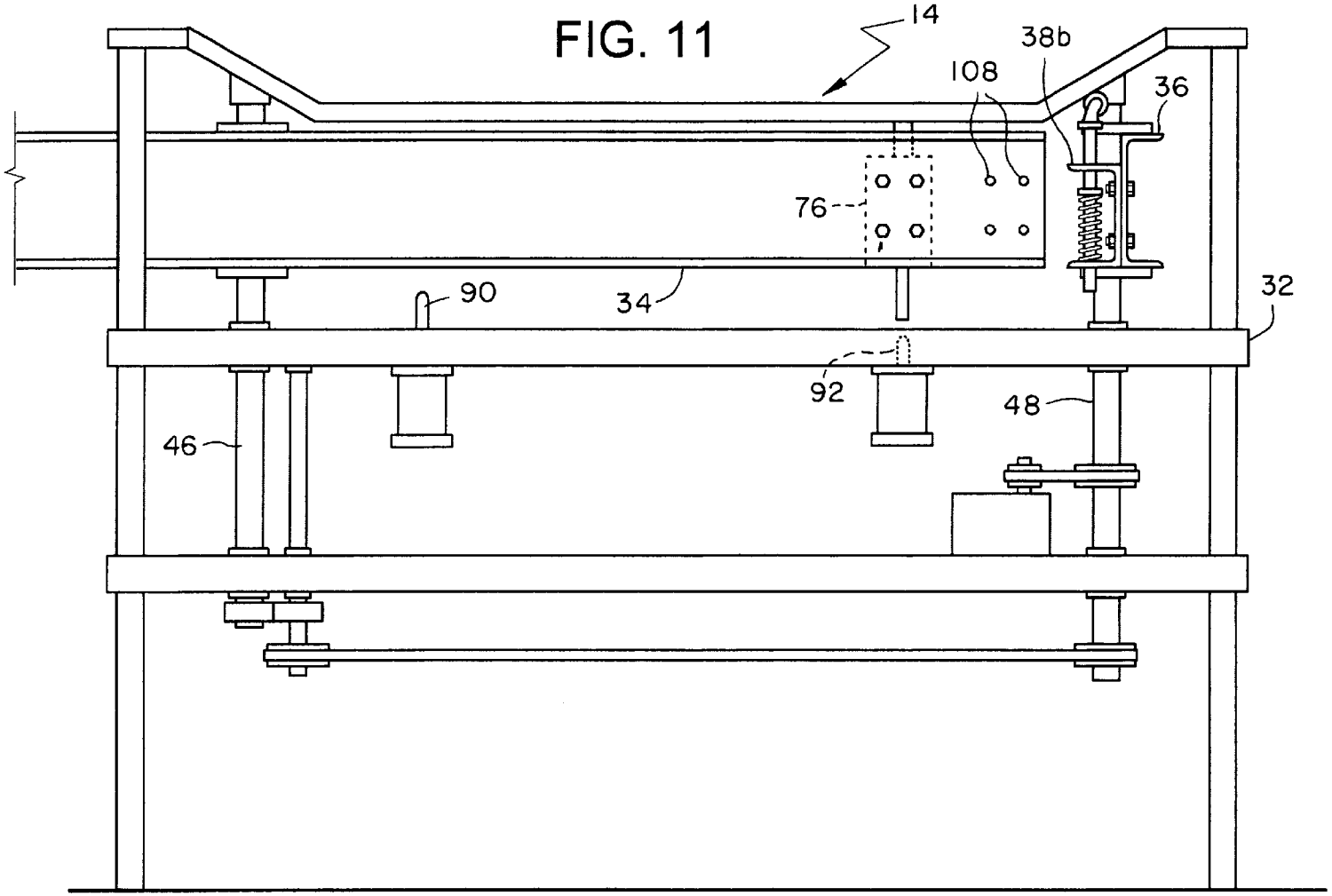
FIG. 11 is a view taken along line 11—11 of FIG. 10, but with the tube omitted to show other features of the invention more clearly.

Although, coil 10 has a specific width 104, tube bender 14 can be adjusted to make a serpentine coil 10' having a narrower width 106, as shown in FIG. 10. To do this, dies 38*a–d* can be moved closer to their corresponding shaft 46 or 48. In FIG. 11, for example, bracket 76 of die 38*a* is unbolted from mounting holes 108 of member 34 and reinstalled closer to shaft 46. Anchors 90 and 92 are also moved closer to each other in a similar unbolting/bolting manner. Of course, there are a wide variety of other common methods of repositioning tooling such as having a lead screw move the dies and anchors along guide tracks.

Although the invention is described with reference to a preferred embodiment, it should be appreciated by those skilled in the art that other variations are well within the scope of the invention. For example, to minimize the bending of tube 15 just as it leaves head 26, spine fin wrapper 20 can be installed much farther away from tube-receiving end 98 than what is shown in the drawing figures. Also, guides can be added to help guide tube 15 as tube 15 travels from head 26 to tube-receiving end 98. Therefore, the scope of the invention is to be determined by reference to the claims, which follow.

I claim:

1. A tube bender adapted to bend a tube into a serpentine shape, comprising:

a frame having a tube-receiving end adapted to receive the tube, a support structure adapted to support the serpentine shape, and a bending region interposed between the tube-receiving end and the support structure;

a first anchor supported by the frame and being adapted to engage the tube;

a second anchor supported by the frame and being adapted to engage the tube, wherein the first anchor and the second anchor are spaced apart from each other and are closer to the support structure than the tube-receiving end;

a first rotating member;

a second rotating member;

a first die adapted to engage the tube in the bending region and being moveable relative to the frame to bend the tube about the first anchor;

a second die adapted to engage the tube in the bending region and being moveable relative to the frame to bend the tube about the second anchor;

a third die adapted to engage the tube in the bending region and being moveable relative to the frame to bend the tube about the first anchor; and a fourth die adapted to engage the tube in the bending region and being moveable relative to the frame to bend the tube about the second anchor;

wherein the first die and the third die are attached to the first rotating member, and the second die and the fourth die are attached to the second rotating member.

2. The tube bender of claim 1, wherein the first anchor is moveable between an extended position to engage the tube and a release position to disengage the tube.

3. The tube bender of claim 1, wherein movement of the first die and the second die is out of phase to each other.

4. The tube bender of claim 1, wherein the first die, the second die, the third die and the fourth die are adapted to engage the tube sequentially as the first rotating member and the second rotating member rotate.

5. The tube bender of claim 1, wherein the first rotating member and the second rotating member rotate substantially 90-degrees out of phase relative to each other.

6. The tube bender of claim 1, further comprising a feed roll adapted to pay out the tube toward tube-receiving end of the frame.

7. The tube bender of claim 6, further comprising a spine fin wrapper interposed between the feed roll and the tube-receiving end of the frame, wherein the spine fin wrapper is adapted to wrap a heat conductive member around the tube.

8. The tube bender of claim 1, wherein the first die is further moveable between an operative position and a retracted position, wherein the operative position allows the first die to engage the tube and the retracted position allows the first die to travel past the tube.

9. The tube bender of claim 8, further comprising a cam surface associated with the first die, wherein the first die moves between the operative position and the retracted position in response to the die moving relative to the cam surface.

10. The tube bender of claim 8, further comprising a spring that urges the first die to the retracted position.

* * * * *